US005941086A

United States Patent [19]

Petrulio et al.

[11] Patent Number: 5,941,086

[45] Date of Patent: Aug. 24, 1999

[54] EXPANSION VALVE UNIT

[75] Inventors: Richard Mark Petrulio, Trabuco Canyon; Michael Alan Williams, Huntington Beach, both of Calif.

[73] Assignee: B/E Aerospace, Inc., Wellington, Fla.

[21] Appl. No.: 08/953,101

[22] Filed: Oct. 17, 1997

Related U.S. Application Data

[63] Continuation of application No. 08/555,001, Nov. 9, 1995, abandoned.

[51] Int. Cl.[6] ..... G05D 23/30

[52] U.S. Cl. ..... 62/202; 62/225; 236/68 R

[58] Field of Search ..... 62/225, 202; 236/68 R, 236/92 B

[56] References Cited

U.S. PATENT DOCUMENTS

| | | | |
|---|---|---|---|
| 2,272,099 | 2/1942 | Smith | 236/68 R |
| 2,319,005 | 5/1943 | Lum | 62/225 |
| 2,534,455 | 12/1950 | Koontz | 62/4 |
| 2,577,903 | 12/1951 | McGrath | 62/225 |
| 3,478,534 | 11/1969 | Matthies | 62/225 |
| 4,171,087 | 10/1979 | Kunz | 236/68 R |
| 4,461,635 | 7/1984 | Rudebeck | 62/202 |
| 4,475,686 | 10/1984 | Huelle et al. | 236/68 C |
| 4,632,358 | 12/1986 | Orth et al. | 251/117 |
| 4,794,762 | 1/1989 | Orth et al. | 62/203 |
| 4,835,976 | 6/1989 | Torrence | 62/115 |
| 4,841,734 | 6/1989 | Torrence | 62/115 |
| 4,878,879 | 11/1989 | Marsala et al. | 62/202 |
| 4,984,735 | 1/1991 | Glennon et al. | 236/92 B |
| 4,995,240 | 2/1991 | Barthel et al. | 62/225 |
| 5,148,978 | 9/1992 | Stapelbroek | 62/225 |
| 5,187,944 | 2/1993 | Jarosch | 62/225 |
| 5,195,331 | 3/1993 | Zimmern et al. | 62/202 |
| 5,515,695 | 5/1996 | Sakakibara et al. | 62/202 |
| 5,546,757 | 8/1996 | Whipple, III | 62/225 |

FOREIGN PATENT DOCUMENTS

| | | | |
|---|---|---|---|
| 1055018 | 4/1959 | Germany . | |
| 3405313A1 | 8/1985 | Germany | F24J 3/00 |
| 8300819 | 10/1984 | Netherlands | F25B 49/00 |

*Primary Examiner*—William E. Tapolcai
*Attorney, Agent, or Firm*—Merchant & Gould

[57] ABSTRACT

A thermal expansion valve unit comprises a closed vapor system, which includes a temperature sensing chamber in thermal communication with a source such as a two phase refrigerant, and a pressure chamber with a deformable member, the position of which controls the size of an expansion orifice. A line confining a selected vapor, which optionally may be a refrigerant, communicates between the interiors of the temperature sensing chamber and the pressure chamber. A heater, separately controllable, is thermally coupled to the temperature sensing chamber such that the selected refrigerant may be independently heated to change the pressure in the chamber. A thickness of insulating material is disposed between the temperature sensing chamber and the source to limit thermal energy loss to refrigerated elements in the system. The pressure in the temperature sensing chamber changes the force on the deformable diaphragm to adjust the movement of the valve needle to regulate the expansion of refrigerant through the orifice, thus affecting the refrigerated load.

2 Claims, 3 Drawing Sheets

EXPANSION VALVE UNIT

This is a continuation of application Ser. No. 08/555,001, filed Nov. 9, 1995, now abandoned.

FIELD OF INVENTION

The present invention relates to control valves, and more particularly to controllable expansion valves for use with vapor-cycle refrigeration systems to sense refrigerant temperature and control refrigerant expansion so as to maintain a settable level in a refrigeration compartment.

BACKGROUND OF THE INVENTION

With refrigeration technology becoming increasingly complex, there is an increasing need for improved thermal expansion for controlling temperatures in compression/expansion refrigeration systems. The need is for both greater stability and more precise control.

Thermal electric expansion valves for regulating the flow of high pressure refrigerant employ a bimetallic strip responsive to temperature to control the position of a valve needle within a valve seat. The bimetallic strip changes shape with temperature, forcing a valve needle with greater or lesser force against a spring acting on the needle. Pressurized refrigerant flowing through the orfice defined between the valve needle and valve seat is therefore allowed to expand at a variable rate, determining the temperature of expanded refrigerant in a two phase state. A heater wire is wrapped around the bimetallic strip. A controller energizes the wire as determined by a circuit responsive to a temperature sensor placed in contact with the refrigerated load. The level set by the control circuit thus can offset the deformation of the strip, and position of the valve needle, so as to predetermine the level of temperature to be maintained in the system.

This type of thermal electric expansion valve is not fully dependable, stable or predictable, because the bimetallic strip is acted upon by other inputs in addition to the heater input. In addition, the bimetallic strip has a degree of hysteresis and is highly sensitive to temperature change. Additionally, this type of thermal expansion valve is costly and inefficient to operate as the system must be adjusted to properly control the valve.

SUMMARY OF THE INVENTION

Devices in accordance with the present invention control a thermal expansion valve by exerting variable vapor pressure on a deformable diaphragm that is coupled to control the size of an orifice passing high pressure refrigerant in liquid phase to an evaporator. A temperature sensing chamber in thermal communication with gas phase refrigerant after evaporation confines a two phase fluid which is coupled by a conduit into a closed chamber incorporating the pressure deformable diaphragm. The diaphragm is coupled to a valve needle within a valve seat in the expansion valve. Temperature changes in the gas initially determine the temperature and therefore the pressure acting on the diaphragm. The pressure changes adjust the position of the valve needle within the valve seat to regulate the flow of refrigerant through the body of the expansion valve.

A heater thermally coupled to the temperature sensing chamber is controllable, as in response to a thermometer sensing the temperature level in the refrigeration chamber, to servo the vapor expansion function to the level chosen for the refrigerated load. The temperature sensing chamber is advantageously physically separated from the refrigerant line by an insulative member, such that the external heat source is isolated and internal temperature changes are integrated. The thermal expansion valve also includes a spring opposite the vapor pressure side for biasing the valve needle and diaphragm in a direction away from the valve seat. Advantageously, the two phase vapor in the closed chambers can be the same as the refrigerant used in the system. This thermal expansion valve maintains a set operating temperature with precision, and is substantially invariant in long term use. It is low in cost, readily inspected and has little susceptibility to change.

BRIEF DESCRIPTION OF THE DRAWINGS

The present invention will be described with reference to the accompanying drawings, wherein like reference numerals identify corresponding or like components.

In the drawings.

DETAILED DESCRIPTION OF THE DRAWINGS

Figure 1:
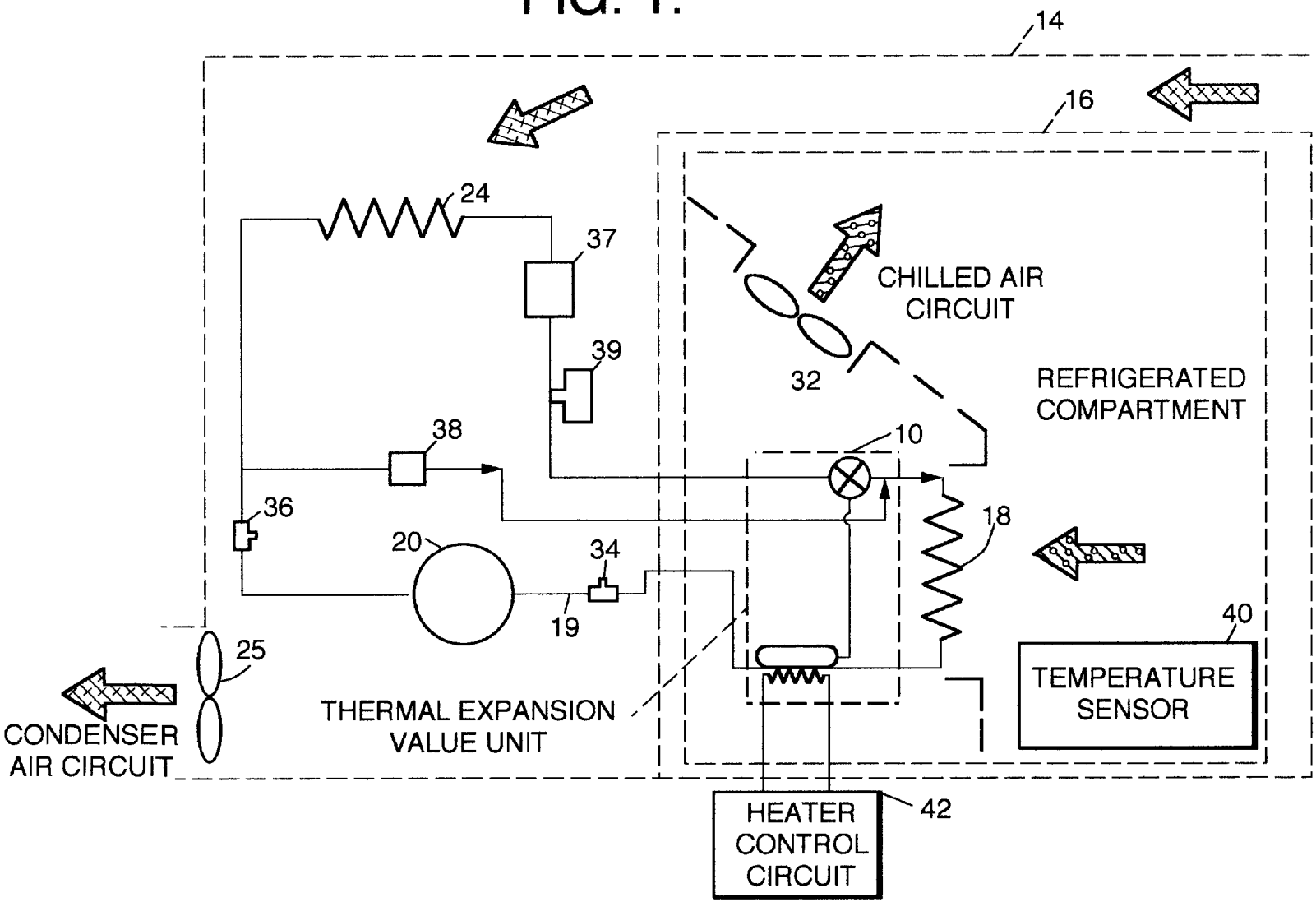
FIG. 1 is a block diagram of a refrigeration system employing the expansion valve unit of the present invention.

FIG. 1 shows in block diagram form a thermal expansion valve unit 10 in accordance with the present invention in use with a compression/evaporator refrigeration system 12. The refrigeration system 12 includes housing 14 containing a refrigerated compartment 16 that is cooled by thermal exchange of heat in the interior air with an evaporator 18 through which refrigerant passes after expansion. The gas phase refrigerant moves from the evaporator 18 to outside the refrigerated compartment 16 and to the suction line 19 of a compressor 20. Outflow of high pressure refrigerant from the compressor 20 is supplied to the condenser 24, across which ambient air is driven by a condenser fan 25, so the condenser 24 lowers the refrigerant temperature such that it changes phase to a high pressure liquid. The high pressure liquid refrigerant enters a thermal expansion valve 30 in the valve unit 10 where it is released into the evaporator 18 at a predetermined rate, determined by the area of an internal valve orifice. In the evaporator 18, the cold expanded refrigerant takes up heat from internal air moved by an evaporator fan 32 in the refrigerated compartment 16. Conventional ancillary devices are used in conjunction with the compressor 20 and condenser 24, such as a low pressure access valve 34 in the compressor suction line and a high pressure access valve 36 in the compressor outflow line.

The refrigeration system 12 also includes an entrance opening for ambient air to enter and pass across the condenser 24. The condenser fan 25 moves the air out of refrigeration unit 12 through an exit opening. Along the refrigerant line, intermediate the condenser 24 and the thermal expansion valve 30 may be a filter/drier 37 and a pressure transducer 39.

Additionally, a hot gas bypass valve 38 is in a shunt path from the compressor outflow line to the inlet line to the evaporator 18, after the thermal expansion valve 30. The expansion valve unit 10 and the evaporator 18 are both located within the refrigerated compartment 16.

Continuing to refer to FIG. 1, the system also includes a temperature sensor 40, such as a thermistor, in the refrigerated compartment 16, and control circuits 42 of conventional form which may manually or automatically, or both, generate an analog signal for actuation of circuits (in this instance, heater circuits) for maintaining the temperature in the refrigerated compartment 16 substantially constant.

In the operation of the system, therefore, the thermal expansion valve unit 10 controls, by the variable orifice in the expansion valve 30, the flow rate of a high pressure refrigerated liquid into the evaporator 18. Expansion to a two phase vapor in the evaporator 18 markedly reduces the temperature at the evaporator surface, enabling extraction of thermal energy from air in the refrigerated compartment 16 as it is circulated across the evaporator 18 by the fan 32. If the refrigerated load increases in temperature, the thermal expansion valve unit 10 increases the flow rate, for a given temperature setting, bringing the temperature back down to the desired level.

Figure 2:
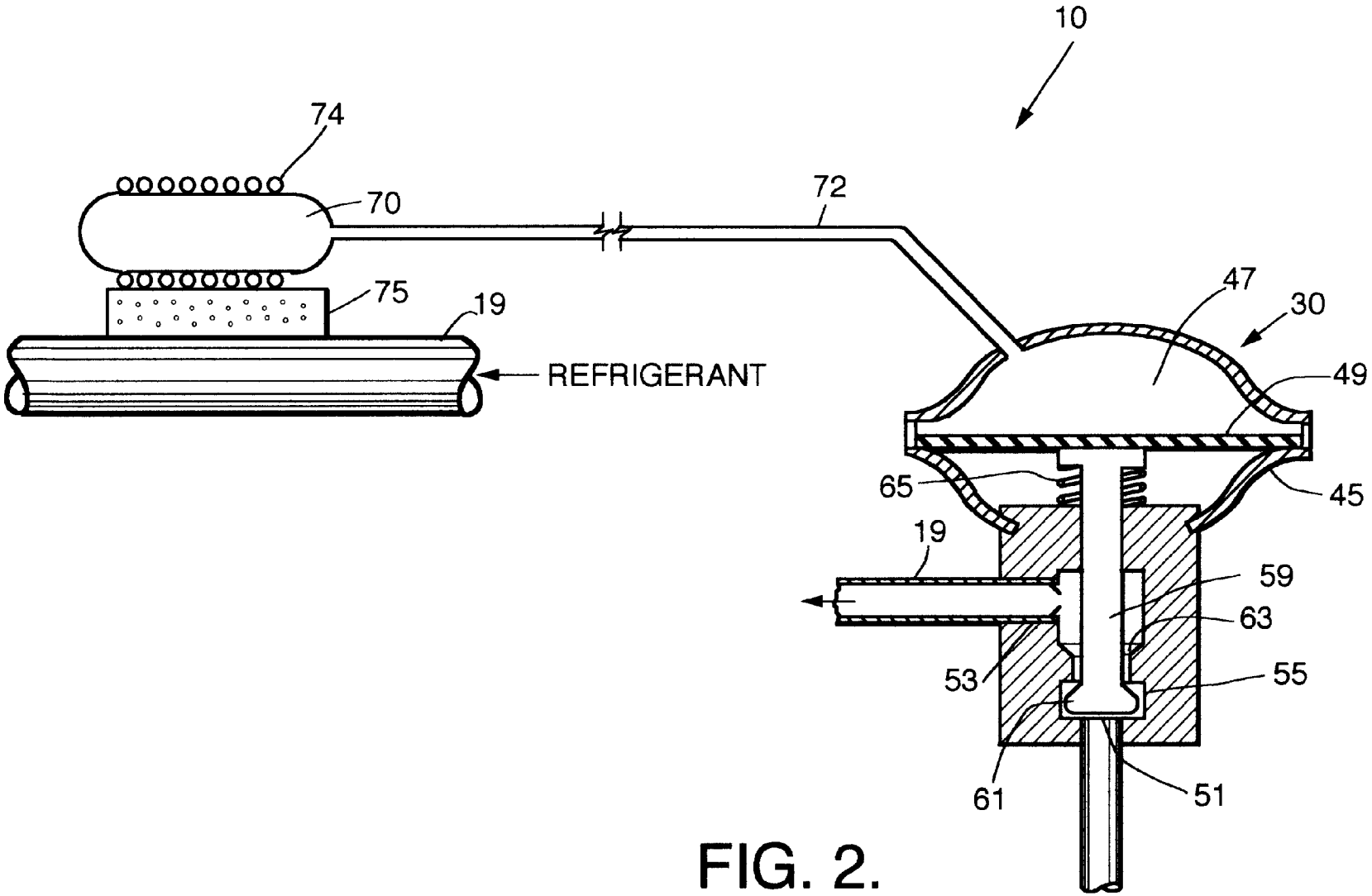
FIG. 2 is a cross-sectional view of a thermal expansion valve in accordance with the present invention.

Referring now to FIG. 2, the thermal expansion valve 30 in the valve unit 10 comprises a valve body 45 having a gas pressure chamber 47 at one side, isolated by a pressure deformable diaphragm 49 from a refrigerant flow path between a refrigerant inlet 51 and a refrigerant outlet 53. The refrigerant inlet 51 receives cooled liquid outflow from the condenser 24, while the refrigerant outlet 53 is coupled to the inlet to the evaporator 18. The valve body on the side of the deformable diaphragm 49 that is opposite the pressure chamber includes what may be called a variable orifice chamber 55, into which extends a needle valve 59 coupled to the diaphragm 49 and moveable with it. The needle valve 59 lies along an axis perpendicular to the plane of the diaphragm 49, and includes a conical segment 61 adjacent the inner walls of a valve seat 63 in the refrigerant inlet line 51. A compression spring 65 about the needle valve between the valve body 45 and the diaphragm 49 biases the diaphragm 49 and the needle valve 59 in the direction opposite to the force exerted by the pressurized gas on the diaphragm 49. Maximum pressure tends to open the variable orifice defined between the conical segments 61 and the valve seat 63.

Along the path of the suction line 19 to the compressor 20 is disposed a temperature sensing chamber 70 which contains a two phase vapor, which in this instance may comprise the same refrigerant as in the refrigeration system 12. A conduit 72 provides an open communication path between the temperature sensing chamber 70 and the pressure chamber 47 in the valve body 45. The nominal pressure level of the two phase vapor is selected to provide a given deformation of the diaphragm 49, so as to provide a chosen nominal size for the variable orifice, thus to maintain a given nominal temperature. However, the temperature in the refrigerated compartment 16 (FIG. 1), under practical operating conditions, can vary dependent upon the thermal load in the compartment 16, ambient air temperature levels, power utilization and other such factors. Accordingly, the control circuits 42 (FIG. 1) are adjustable to energize heater coils 74 in thermal interchange relation to the temperature sensing chamber 70, so as to control the absolute level of the vapor temperature in the chamber 70, and since the pressurized vapor is in a closed volume, change the internal pressure and therefore the extent of deformation of the diaphragm 49 accordingly. Significant advantages in operation are achieved by inclusion of a layer of insulation 75 between the temperature sensing chamber 70 and the suction line 19 with which it is in contact. The primary advantage is that the temperature in the sensing chamber 70, and therefore the pressure, can be varied rapidly and precisely, without substantial thermal losses to the chamber 70 and the relatively cold suction line 19. As a stable state is reached, moreover, a secondary advantage is that temperature level changes at the suction line 19 are effectively integrated, adding to the stability of the system.

Thermal expansion valve units 10 in accordance with the invention can be seen to be free of the change in mechanical characteristics and hysteresis that characterize the bimetallic elements used in the prior art, and have long life and substantially no wear factors. The unit is compact and readily maintained and adjusted, if need be.

Figure 3:
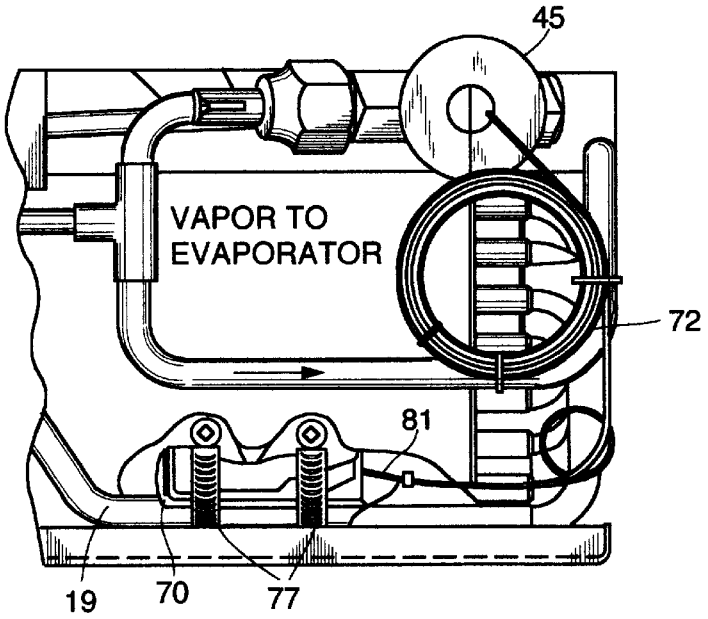
FIG. 3 is a side view of a thermal expansion valve unit in association with an evaporator shown only generally.
Figure 4:
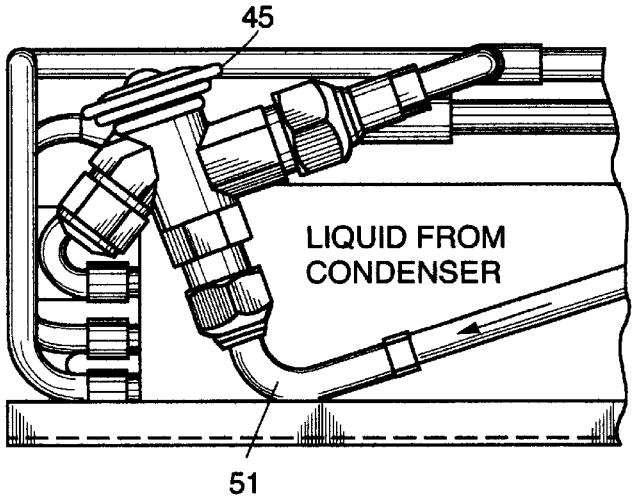
FIG. 4 is a top view of the arrangement of FIG. 3.
Figure 5:
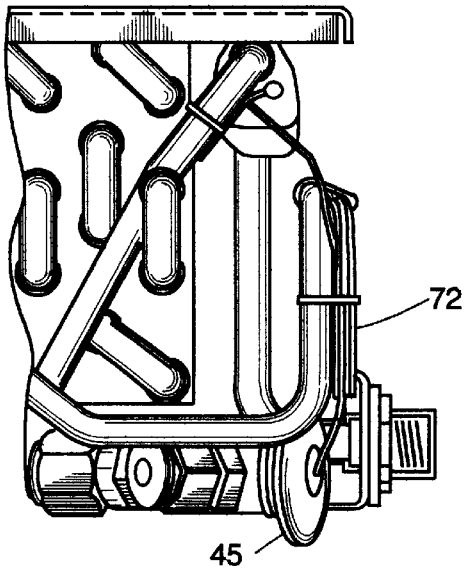
FIG. 5 is an end view of the arrangement of FIGS. 3 and 4.

The views of FIGS. 3, 4 and 5, which depict the relevant portions of a practical system in accordance with the invention, evidence the simplicity of the construction. The temperature sensing chamber 70 is secured to the suction line 19 by straps 77, and the conduit 72 is formed as a number of loops that allow for expansion and contraction without impeding communication of pressure changes. Electrical heater coils 81 wrapped partially about the temperature sensing chamber 70 provide a fully satisfactory result, although it will be appreciated that heating coils and extended heat exchange surfaces coupled thereto may be disposed interior to the chamber 70 if an extremely fast response is desired.

While a number of forms and variations have been described so as to enable one skilled in the art to practice the techniques of the present invention the preceding description is intended to be exemplary and should not be used to limit the scope of the invention, which should be determined by reference to the following claims.

We claim:

1. A refrigeration system of the type in which a refrigerated compartment is cooled by thermal interchange in the compartment at an evaporator between air and an expanded refrigeration fluid that has previously been externally pressurized and cooled, comprising:

a compressor-condenser system exterior to the refrigerated compartment and including a refrigeration fluid in a refrigeration fluid line, the compressor-condenser system receiving low pressure refrigeration fluid to which thermal energy has been introduced in the refrigerated compartment and delivering high pressure refrigeration fluid cooled with an ambient temperature fluid;

an evaporator in the refrigeration compartment and coupled in the refrigeration fluid flow path to receive high pressure, cooled delivered fluid from the compressor-condenser system and provide low temperature expanded refrigeration fluid in the fluid line for thermal exchange with air in the refrigerated compartment;

thermal expansion valve means disposed along the refrigeration fluid line from the compressor-condenser system for providing refrigeration fluid to the evaporator, said valve means including pressure chamber means, deformable diaphragm means bounding said pressure chamber means, and a movable valve element coupled to the diaphragm means and providing a variable size orifice in the refrigeration line dependent on diaphragm position to control flow of refrigeration fluid to the evaporator;

temperature sensing means disposed adjacent the evaporator in thermal communication with the refrigeration fluid path from the evaporator to the compressor-condenser system, the temperature sensing means comprising a fluid pressure chamber and refrigeration fluid therein;

conduit means coupling refrigeration fluid in the fluid pressure chamber to the interior of the pressure chamber means;

adjustable heater means thermally coupled to a portion of the fluid pressure chamber for adjustably varying the temperature of the refrigeration fluid in the sensor line means in accordance with a desired temperature for the refrigerated compartment to offset the temperature and pressure of the refrigeration fluid such as to change the operating position of the diaphragm, and displace the diaphragm in accordance with the balance of thermal energy between the thermal communication from the heater means and the temperature sensing means to maintain the temperature in the refrigerated compartment substantially constant at a selected steady state level;

insulation means disposed between the refrigeration line and the fluid pressure chamber to partially attenuate heat interchange therebetween such as to integrate temperature variations occurring in the refrigeration line from the evaporator and isolate the refrigeration line from the thermal energy of the adjustable heater means; and temperature control means for the refrigerated compartment including a temperature sensor in the refrigerated compartment and a control circuit responsive to the temperature sensor and coupled to provide a selectable control signal to the adjustable heater means.

2. A valve system for the control of the expansion to two phase vapor of a high pressure fluid in a flow path to control thermal energy extraction from a refrigerated load comprising:

a valve body having a pressure cavity and an adjacent flow orifice adjacent thereto and coupled in the path of the high pressure fluid;

a deformable diaphragm disposed in the valve body to form one wall of the pressure cavity and being movable in response to the pressure level in the pressure cavity;

valve control means adjacent the deformable diaphragm and including means variably positioned relative to the flow orifice to modify the orifice area in accordance with diaphragm position, said means comprising a valve needle having a tapered section adjacent the flow orifice and spring means biasing the diaphragm in a direction opposite to the pressure exerted by the gas phase fluid in the diaphragm;

first temperature input means disposed in thermal interchange relation with the flow path of the fluid after expansion, the first temperature input means comprising a chamber for a two phase vapor, from the same fluid as the high pressure fluid, and conduit means coupling the interior of the chamber to the pressure cavity in the valve body;

second temperature input means comprising adjustable heater means in thermal exchange relation to the first temperature input means for introducing a controllable offset in the pressure of the vapor communicated to the pressure cavity; and temperature control means including a temperature sensor responsive to the temperature of the refrigerated load and a control circuit responsive to the temperature sensor and coupled to provide a selectable control signal to the adjustable heater means; and means providing a degree of thermal insulation between the first temperature input means and the flow path of the fluid after expansion such as to integrate thermal energy interchanges therebetween and to isolate the second temperature input means from the flow path of the fluid.

* * * * *